US008776591B2

(12) United States Patent
Le Foll et al.

(10) Patent No.: US 8,776,591 B2
(45) Date of Patent: Jul. 15, 2014

(54) DOWNHOLE, SINGLE TRIP, MULTI-ZONE TESTING SYSTEM AND DOWNHOLE TESTING METHOD USING SUCH

(75) Inventors: Pierre F Le Foll, La Foret Fouesnant (FR); James G. Filas, Missouri City, TX (US); Christopher Sarvari, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 759 days.

(21) Appl. No.: 12/745,582

(22) PCT Filed: Nov. 28, 2008

(86) PCT No.: PCT/EP2008/010119

§ 371 (c)(1),
(2), (4) Date: Oct. 19, 2010

(87) PCT Pub. No.: WO2009/068302

PCT Pub. Date: Jun. 4, 2009

(65) Prior Publication Data

US 2011/0048122 A1 Mar. 3, 2011

Related U.S. Application Data

(60) Provisional application No. 60/991,445, filed on Nov. 30, 2007.

(51) Int. Cl.
*E21B 47/01* (2012.01)

(52) U.S. Cl.
USPC ..... 73/152.17

(58) Field of Classification Search
USPC ..... 73/152.18, 152.23, 152.28, 152.17, 73/52.18; 166/146, 147, 191
See application file for complete search history.

(56) References Cited

U.S. PATENT DOCUMENTS 2,564,198 A * 8/1951 Elkins ..... 73/152.18
2,781,663 A * 2/1957 Maly et al. ..... 73/152.26

(Continued)

FOREIGN PATENT DOCUMENTS

CN 2881096 3/2007

OTHER PUBLICATIONS

Office action for the equivalent Chinese patent application No. 200880118348.3 issued on May 9, 2013.

(Continued)

*Primary Examiner* — John Fitzgerald
(74) *Attorney, Agent, or Firm* — Cameron R. Sneddon

(57) ABSTRACT

A multizone testing system (100), for the testing of subterranean layers, comprises an upper subsystem (109) comprising a control station (151), a main isolation packer (113) for isolating the upper subsystem (109) from the lower subsystem (111), a lower subsystem (111) comprising an array of individual apparatuses (116) connected in series, each apparatus (116) being adapted for the testing of one layer and comprising a series of remotely activated tools for hydraulically isolating and testing the corresponding layer and a communication system comprises communication means between the control station (151) and the surface and between the control station (151) and each of the individual apparatuses (116) in order to control the remotely activated tools of the individual apparatuses for sequential testing of the layers. A multizone testing method for the testing of a plurality of subterranean layers intersected by a well, using a multizone testing system (100) comprises the steps of running and positioning said system (100) into the well such that each individual apparatus (116) is adjacent to a layer to be tested and controlling the remotely activated tools of the individual apparatuses for a sequential test of the layers.

17 Claims, 7 Drawing Sheets

(56) References Cited

U.S. PATENT DOCUMENTS

| | | | | |
|---|---|---|---|---|
| 3,605,887 | A | 9/1971 | Lambie | |
| 4,794,989 | A * | 1/1989 | Mills | 166/387 |
| 4,796,669 | A | 1/1989 | St. Onge | |
| 4,838,079 | A * | 6/1989 | Harris | 73/152.18 |
| 4,856,595 | A | 8/1989 | Upchurch | |
| 4,896,722 | A | 1/1990 | Upchurch | |
| 4,898,236 | A * | 2/1990 | Sask | 166/65.1 |
| 4,915,168 | A | 4/1990 | Upchurch | |
| 4,971,160 | A | 11/1990 | Upchurch | |
| 5,050,675 | A | 9/1991 | Upchurch | |
| 5,137,086 | A | 8/1992 | Stokley et al. | |
| 5,160,925 | A * | 11/1992 | Dailey et al. | 340/853.3 |
| 5,273,112 | A * | 12/1993 | Schultz | 166/374 |
| 5,540,281 | A * | 7/1996 | Round | 166/250.17 |
| 5,598,894 | A | 2/1997 | Burleson et al. | |
| 5,638,904 | A * | 6/1997 | Misselbrook et al. | 166/384 |
| 5,691,712 | A | 11/1997 | Meek et al. | |
| 5,706,896 | A * | 1/1998 | Tubel et al. | 166/313 |
| 5,955,666 | A * | 9/1999 | Mullins | 73/152.18 |
| 6,176,312 | B1 * | 1/2001 | Tubel et al. | 166/250.15 |
| 6,192,988 | B1 * | 2/2001 | Tubel | 166/313 |
| 6,196,064 | B1 * | 3/2001 | Patton et al. | 73/152.28 |
| 6,279,660 | B1 * | 8/2001 | Hay | 166/336 |
| 6,320,820 | B1 * | 11/2001 | Gardner et al. | 367/81 |
| 6,464,011 | B2 * | 10/2002 | Tubel | 166/313 |
| 6,497,290 | B1 | 12/2002 | Misselbrook et al. | |
| 6,527,050 | B1 * | 3/2003 | Sask | 166/299 |
| 7,207,215 | B2 * | 4/2007 | Spross et al. | 73/152.03 |
| 7,231,978 | B2 * | 6/2007 | Rivas et al. | 166/297 |
| 7,322,417 | B2 * | 1/2008 | Rytlewski et al. | 166/313 |
| 7,373,813 | B2 * | 5/2008 | DiFoggio | 73/152.55 |
| 7,387,165 | B2 * | 6/2008 | Lopez de Cardenas et al. | 166/313 |
| 7,980,306 | B2 * | 7/2011 | Lovell et al. | 166/250.17 |
| 8,448,703 | B2 * | 5/2013 | Ross et al. | 166/250.1 |
| 2001/0013412 | A1 * | 8/2001 | Tubel | 166/250.01 |
| 2003/0192692 | A1 * | 10/2003 | Tubel | 166/250.15 |
| 2004/0226720 | A1 * | 11/2004 | Schultz et al. | 166/321 |
| 2005/0077086 | A1 | 4/2005 | Vise, Jr. | |
| 2005/0200498 | A1 * | 9/2005 | Gleitman | 340/854.4 |
| 2006/0124297 | A1 * | 6/2006 | Ohmer | 166/250.01 |
| 2006/0207764 | A1 | 9/2006 | Rytlewski | |
| 2006/0231256 | A1 * | 10/2006 | Rivas et al. | 166/297 |
| 2007/0055536 | A1 * | 3/2007 | Caveny et al. | 705/1 |
| 2007/0193351 | A1 * | 8/2007 | DiFoggio | 73/152.02 |
| 2007/0235185 | A1 * | 10/2007 | Patel et al. | 166/250.01 |
| 2008/0042869 | A1 * | 2/2008 | Zimmerman | 340/853.2 |
| 2008/0173083 | A1 * | 7/2008 | Kasperski et al. | 73/152.23 |
| 2008/0211687 | A1 * | 9/2008 | Price et al. | 340/854.3 |
| 2008/0253228 | A1 * | 10/2008 | Camwell et al. | 367/82 |
| 2009/0020283 | A1 * | 1/2009 | Manin et al. | 166/147 |
| 2009/0241658 | A1 * | 10/2009 | Irani et al. | 73/152.23 |
| 2009/0260807 | A1 * | 10/2009 | Abou El Azm et al. | 166/250.17 |
| 2010/0258304 | A1 * | 10/2010 | Hegeman | 166/250.01 |
| 2011/0042067 | A1 * | 2/2011 | Weikel et al. | 166/127 |
| 2011/0114310 | A1 * | 5/2011 | Ross et al. | 166/250.17 |
| 2011/0272148 | A1 * | 11/2011 | Lovell et al. | 166/250.17 |

OTHER PUBLICATIONS

Office action for the equivalent Mexican patent application No. MX/A/2010/005562 issued on May 17, 2013.

Office action for the equivalent Chinese patent application No. 200880118348.3 issued on Oct. 15, 2013.

* cited by examiner

| | | Flow | Build-up |
|---|---|---|---|
| Valves | 115 | OPEN | OPEN |
| | 121 | OPEN | OPEN |
| | 119 | OPEN | OPEN |
| | 117 | OPEN | CLOSED |
| Pressure | 127 | L1F1 | |
| | 125 | | |
| | 123 | | L1Bup |

FIG. 7A

| Flow | Build-up |
|---|---|
| OPEN | OPEN |
| OPEN | OPEN |
| OPEN | CLOSED |
| CLOSED | CLOSED |
| L2F1 | |
| | L2Bup |
| L1Bup | L1Bup |

FIG. 7B

| Flow | Build-up |
|---|---|
| OPEN | OPEN |
| OPEN | CLOSED |
| CLOSED | CLOSED |
| CLOSED | CLOSED |
| L3F1 | L2Bup |
| L2Bup | L2Bup |
| L1Bup | L1Bup |

FIG. 7C

| Flow | Build-up |
|---|---|
| OPEN | CLOSED |
| OPEN | OPEN |
| OPEN | OPEN |
| OPEN | OPEN |
| CFI | CBup |

FIG. 7D

DOWNHOLE, SINGLE TRIP, MULTI-ZONE TESTING SYSTEM AND DOWNHOLE TESTING METHOD USING SUCH

CROSS-REFERENCE TO RELATED APPLICATIONS

This application claims of priority to U.S. Provisional Patent Application Ser. No. 60/991,445 filed Nov. 30, 2007, which is incorporated herein by reference.

BACKGROUND OF INVENTION

1. Field of the Invention

The invention relates to downhole well testing which is a broad term to designate methods to evaluate subterranean rock layers intersected by a well for their potential to produce hydrocarbons.

2. Description of the Prior Art

Downhole well testing consists in lowering an apparatus or combination of apparatuses in the well in order to hydraulically isolate the layer of interest from the rest of the well and enable that layer to either flow into a chamber that is part of the combination of apparatuses or to flow to surface via suitable pipes that are connected to the apparatuses.

After a wellbore has been drilled through the formation, the various layers of the formation are perforated using perforating guns. Following perforation, testing, such as drillstem testing, is performed. Drillstem testing (DST) is a procedure to determine the productive capacity, pressure, permeability and nature of the reservoir fluids, or extent (or some combination of these characteristics) of a hydrocarbon reservoir in each layer of the formation.

In the field of oil and gas well testing, it is common to encounter wells that traverse more than one separate subterranean hydrocarbon bearing zones which may have similar or different characteristics.

In this event, it is today necessary to perform as many Drill Stem Test (DST) trips in the well as there are layers to be tested. This is a source of considerable non-productive time for a drill stem downhole testing operations.

Currently when several layers that are intersected by a given well are to be tested, a separate downhole test is performed on each layer, sequentially starting from the bottom of the well, using a drillstem testing tool (DST tool) also called a test string. At the end of each test, said test string is removed from the well to enable the layer that was just tested to be hydraulically isolated from the well and the test tools to be reset for the next run of the string in the well.

A typical sequence deployed to test two zones in a given well with a downhole testing system according to the prior art is illustrated in FIGS. 1*a* to 1*f*.

As shown in FIG. 1*a*, the test string 3 comprising a packer 7, a perforating gun system 9 and a tester valve 13 is run into the well 5 in order to position the perforating gun system 9 adjacent to the lowest layer of interest 1. Packer 7 is set to isolate layer 1 from the well bore 5. The layer 1 is then perforated with the perforating gun 9, as shown on FIG. 1*b*. Accordingly, the layer material 11 flows into the well bore 5 and inside the test string 3 and is tested. For example, pressure is measured and sampling of layer material is performed via pressure gauges and samplers typically positioned below the tester valve 13. The layer 1 is then killed, packer 7 is unset and the test string 3 is pulled from the well 5. Layer 1 is isolated from the upper part of the well bore 5 by setting a plug 15 across or above it (FIG. 1*c*). The test string 3 is reset and the perforating gun 9 is prepared for the test of the following layer

2. As illustrated on FIG. 1*d*, the test string 3 is run again into the well 5 to test the layer 2. Packer 7 is set to isolate layer 2 from the well bore 5. The layer 2 is perforated with the perforating gun 9 (FIG. 1*e*). Layer material 17 flows in the well bore 5 and in the test string 3 and is tested. Once again, pressure may be measured and sampling of layer material may be performed via pressure gauges and samplers positioned below the tester valve 13. Layer 2 is then killed, packer 7 is unset and the test string 3 is pulled from the well 5. On FIG. 1*f*, layer 2 is isolated from the upper part of the well bore 5 by setting a plug 19 across or above it. Successively, all additional layers of the well 5 may be tested in the same way.

In the system as described above, the test string 3 needs to be removed for each layer to be tested, for the test string 3 to be reset and a plug to be set. As a result, the downhole testing of multiple layers in a wellbore may be a lengthy and costly process.

It may take up to several days which may be costly in terms of labor and equipment costs and which delays the completion of a wellbore.

An example of a multizone testing system is disclosed in U.S. Patent Application No. 2006/0207764. This application relates to an assembly enabling a plurality of layers of interest to be sequentially tested. Said assembly comprises a plurality of valves, each being actuatable by dropping a valve-actuating object into the corresponding valve. The valves are successively actuatable to an open state in a predetermined sequence and the different layers are tested or stimulated after actuating corresponding valves to the open state.

The document mentioned above describes a downhole testing system principally related to the stimulation of the layers. Once actuated, the valves cannot be closed. Accordingly, it doesn't provide any flexibility in the testing of the layers.

The system of the present invention solves the above-mentioned problems by providing a testing system which may be used to test several layers within a single trip of the downhole test string in the well and which provides flexibility in the testing of the layers.

SUMMARY OF INVENTION

According to a first aspect, the invention relates to a multizone testing system, for the testing of subterranean layers, comprising an upper subsystem comprising a control station and a main isolation packer for isolating the upper subsystem from the lower subsystem, a lower subsystem comprising an array of individual apparatuses connected in series, each apparatus being adapted for the testing of one layer and comprising a series of remotely activated tools for hydraulically isolating and testing the corresponding layer. It further comprises a communication system comprising communication means between the control station and the surface and between the control station and each of the individual apparatuses in order to control the remotely activated tools of the individual apparatuses for sequential testing of the layers. The communication system also retrieves data collected by the various tools to the surface.

According to a second aspect, the invention relates to a multizone testing method, for the testing of a plurality of subterranean layers intersected by a well, using a multizone testing system according to the first aspect of the present invention, comprising the steps of running and positioning said system into the well such that each individual apparatus is adjacent to a layer to be tested and controlling the remotely activated tools of the individual apparatuses for a sequential test of the layers.

Other aspects and advantages of the invention will be apparent from the following detailed description and the appended claims.

BRIEF DESCRIPTION OF DRAWINGS

FIGS. 7*a* to 7*d* show a table summarizing the states of the different valves (open or closed state) and the different pressure measurements made during a sequential multi-zone testing using a system according to one embodiment of the present invention.

DETAILED DESCRIPTION OF THE INVENTION

Figures 1A, 1B, 1C, 1D, 1E, 1F:
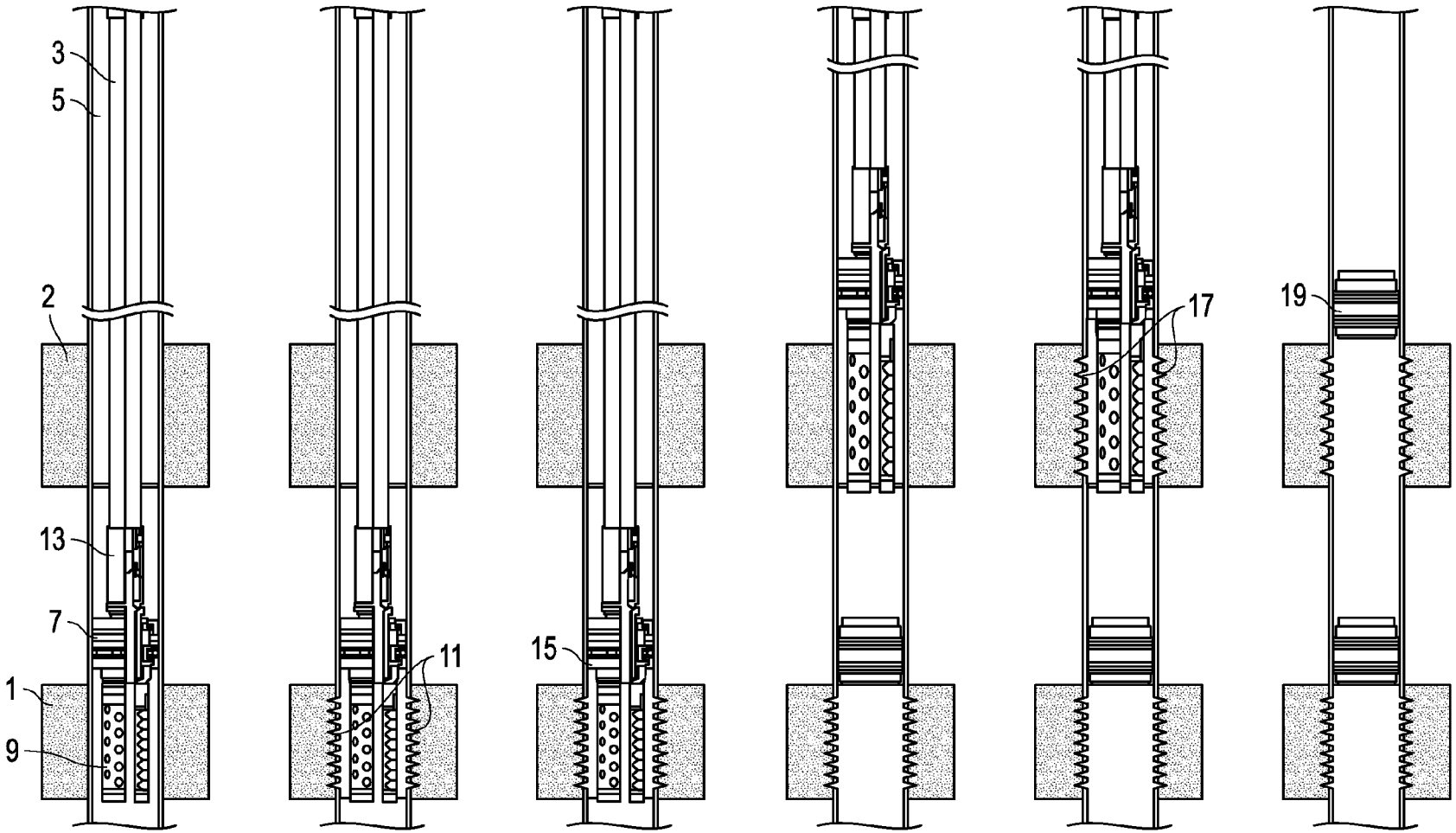
FIG. 1A (Prior Art)
FIG. 1B (Prior Art)
FIG. 1C (Prior Art)
FIG. 1D (Prior Art)
FIG. 1E (Prior Art)
FIG. 1F (Prior Art)
FIGS. 1*a* to 1*f* illustrate conventional testing sequences from the prior art (already described).

Exemplary embodiments of the invention will now be described in detail with reference to the accompanying figures, in which like elements may be denoted by like reference numerals for consistency.

In the following description, the terms "up" and "down", "upper" and "lower", "above" and "below" and other like terms indicating relative positions above or below a given point or element are used to more clearly describe some embodiments of the invention. However, when applied to equipment or methods for use in wells that are deviated or horizontal, such terms may refer to a left to right, right to left, or other relationship as appropriate.

Referring now to the figures and more particularly to FIGS. 2 to 6, the downhole, single trip, multi-zone testing system of the present invention is shown and generally designated by numeral 100.

System 100 is designed for use in a well 107 and is equipped with an inner tubing 104 in which the layers' material may flow. Typically, well 107 will have a plurality of well formations or layers of interest, such as designated by numerals 101, 102 and 103 (FIGS. 4 and 6). The exact configuration of wells may vary, of course, and additional formations or layers may be present. For purposes of description, only three layers of interest 101-103 are shown but it is understood that the present invention has application to isolate and test any number of layers in a well.

Figure 2:
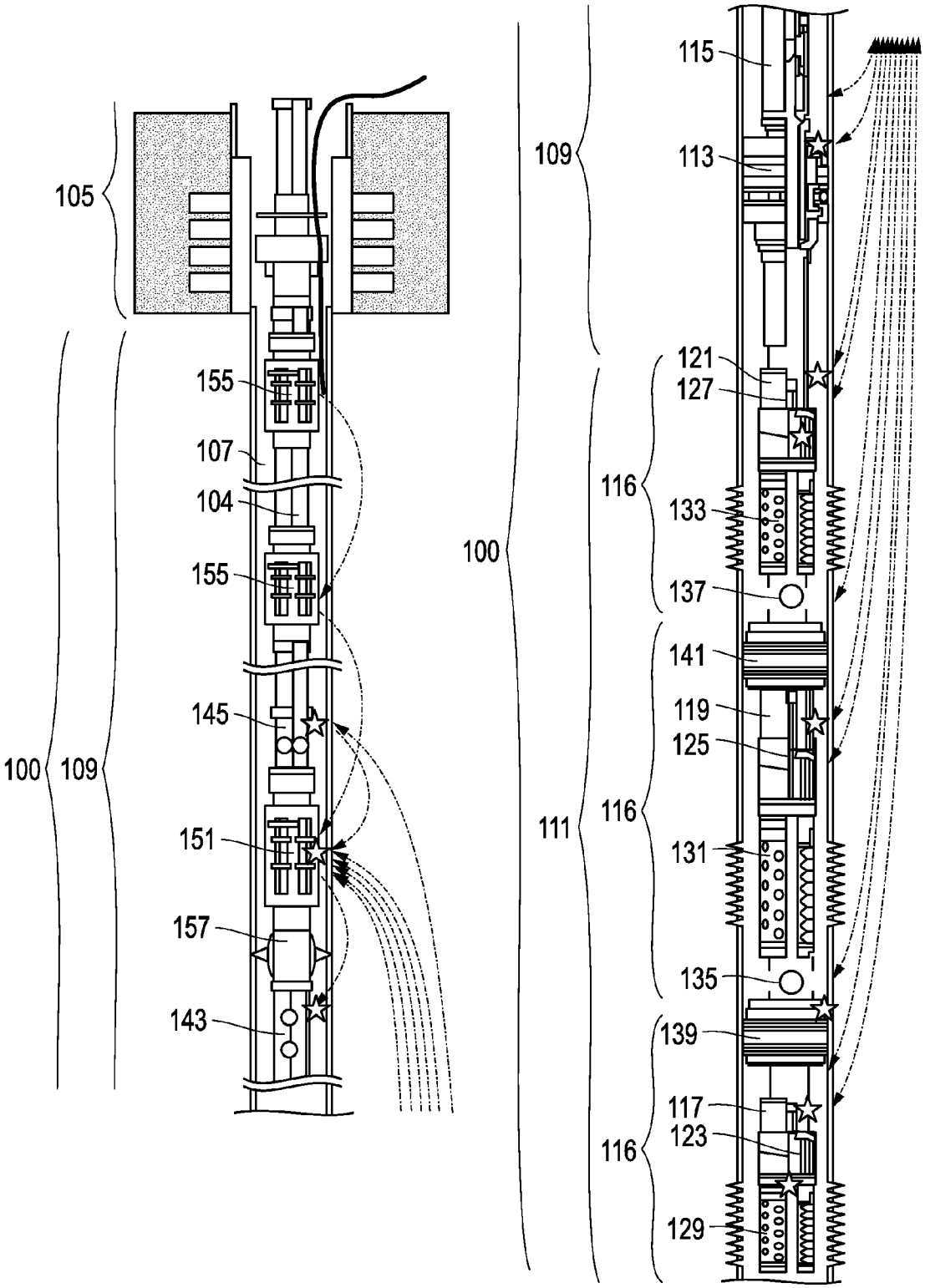
FIG. 2 shows a system according to one embodiment of the present invention positioned in the well bore.

As shown on FIG. 2, the downhole multizone testing system 100 comprises two subsystems, an upper subsystem 109 and a lower subsystem 111.

In the example embodiment of FIG. 2, the upper subsystem 109 comprises a control station 151 and a main isolation packer 113 for isolating the upper subsystem 109 from the lower subsystem 111. It further comprises a main valve 115 that serves to permit or to prevent the flow of layer material from the lower subsystem 111 to the upper subsystem 109. This main valve 115 may be for example a dual-valve, made of a sleeve valve and a ball valve such as Schlumberger IRIS valves which are described in and claimed in U.S. Pat. Nos. 4,971,160, 5,050,675, 5,691,712, 4,796,669, 4,856,595, 4,915,168 and 4,896,722 assigned to Schlumberger and which are incorporated herein by reference for all purposes. The system further comprises a remotely controllable fluid analyzer 143, for analyzing the composition of each individual layer 101-103, a remotely controllable flow meter 145, for measuring the flow of the layers 101-103, individually or commingled. According to this example, the upper subsystem 109 further comprises a remotely controllable back-up pressure gauge and a remotely controllable sampler carrier (not shown in the Figures).

The lower subsystem 111, located below the main packer 113, comprises an array of individual apparatuses 116 connected in series, each apparatus 116 being adapted for the testing of one layer and comprising a series of remotely activated tools for hydraulically isolating and testing the corresponding layer.

Under operation, the downhole multizone testing system 100 is run and positioned into the well such that each individual apparatus is adjacent to a layer to be tested.

In the example embodiments illustrated on FIGS. 2 and 4*a* to 4*c*, the remotely activated tools of each individual apparatus 116 comprise a perforating gun system 129, 131, 133 used to perforate the well 107 in the zone adjacent to a layer 101-103, a flow port 135, 137 enabling layer material to flow from the inner tubing 104 of the system 100 into the well case 107. The remotely activated tools further comprise a tester valve 117, 119, 121 to hydraulically isolate the corresponding layer 101-103, an isolation packer 139, 141 for isolating one layer from another adjacent one and testing means.

The testing means advantageously comprise a pressure gauge 123, 125, 127, and a sampling device (not shown in the Figures) to allow the sampling of the tested layer's material.

The tester valves 117, 119, 121 may be remotely controlled to an open or shut-in state and are used to hydraulically isolate the corresponding layers 101-103. The valves 117, 119, 121 allow the layer 101-103 to flow from the well 107 to the upper part of the testing system 100 via the inner tubing 104 of the system 100. In the embodiments shown on FIGS. 2, 4*a* to 4*c*, and 5*a* and 5*b*, the tester valves 117, 119, 121 are sleeve valves.

The packers 139, 141, when set, are used to isolate the different layers 101-103 of the well 107. They enable each zone of interest 101-103 to be independently and individually perforated using the perforating gun systems 129, 131, 133 and tested by, for example, pressure measurements and sampling of the layers material.

Figure 3:
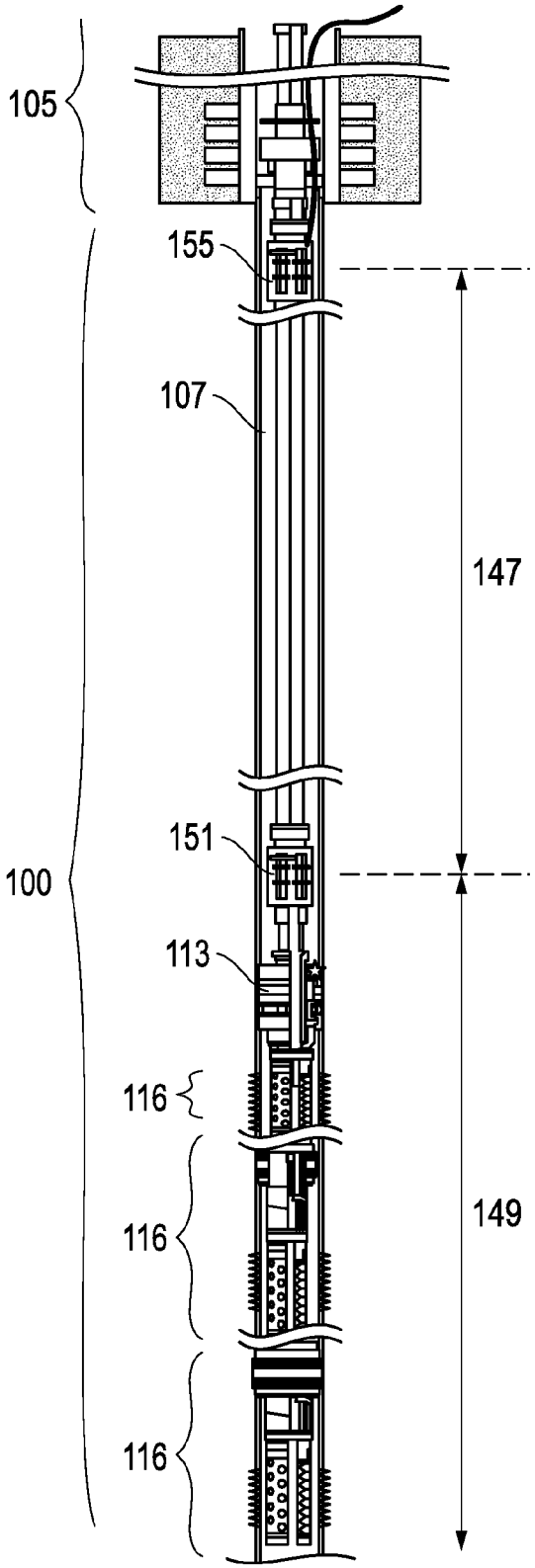
FIG. 3 shows a system according to one embodiment of the present invention.

FIG. 3 describes in more details the communication system of a multizone testing system, according to a preferred embodiment. It comprises communication means between the control station 151 and the surface 105, and between the control station 151 and each of the individual apparatuses 116 in order to control the remotely activated tools of the individual apparatuses 116 for sequential testing of the layers 101-103. It may also include communication means between the individual apparatuses 116.

According to one aspect of the present invention, the control station 151 is a wireless control station and is equipped with a control station antenna 157 (FIG. 2) enabling the wireless signal to be captured and emitted.

In another preferred embodiment, communication means between the control station 151 and the surface 105 comprise one or more repeaters 155 to relay the wireless communication between the control station 151 and the surface 105.

In a preferred embodiment, the communication means comprise a long hop link 147 that takes care of the global communication between the surface 105 and the control station 151. Depending on the well characteristics, the long hop link 147 may also include one or more repeaters 155 to relay the communication. The long hop link 147 may be for example an electromagnetic link.

The communication means between the individual apparatuses 116 and between the control station 151, and between the individual apparatuses 116 comprise a short hop link 149, advantageously an acoustic link.

Generally speaking, the communication system enables tool status and data obtained downhole to be conveyed in real time or near real time to surface 105 as well as sending, from surface 105, activation commands to the tools and receiving back a confirmation that the commands have been properly executed.

On FIG. 2, different communication signals from, for example, the individual tools 116, the flow meter 145, the fluid analyzer 143 to the station 151 and from the station 151 to the surface 105 via repeaters 155 are represented by discontinuous double arrows.

Figure 4A:
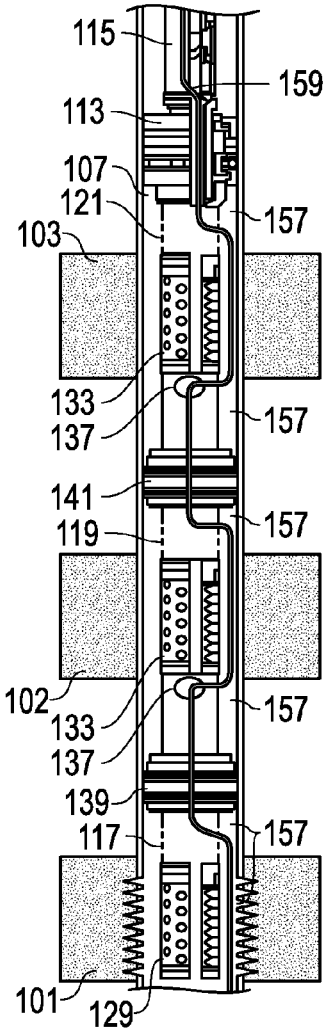
FIGS. 4*a* to 4*c* illustrate the sequential multi-zone testing using the system according to one embodiment of the present invention.
Figure 4B:
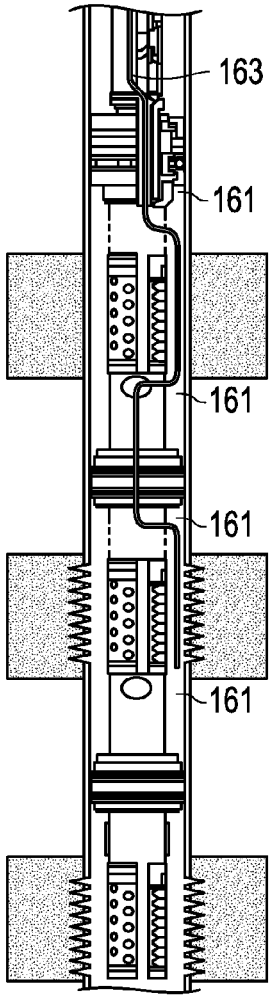
Figure 4C:
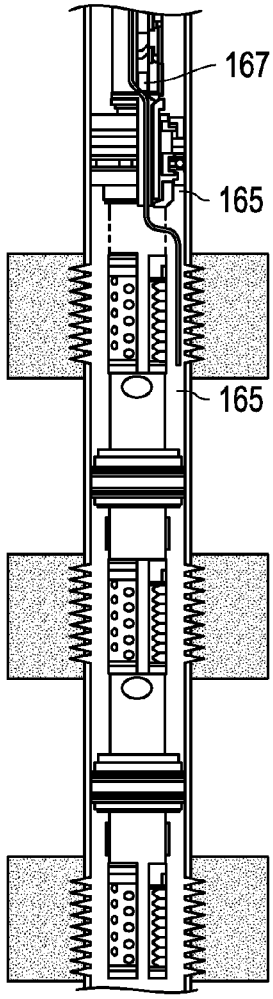
Figure 5A:
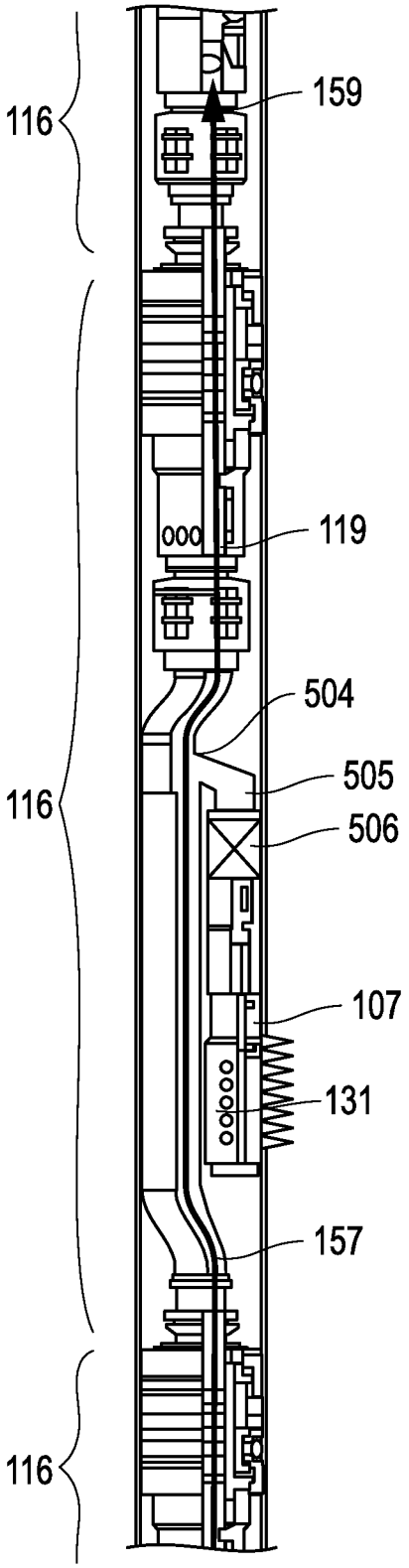
FIGS. 5*a* and 5*b* illustrate the sequential multi-zone testing using the system according to another embodiment of the present invention.
Figure 5B:
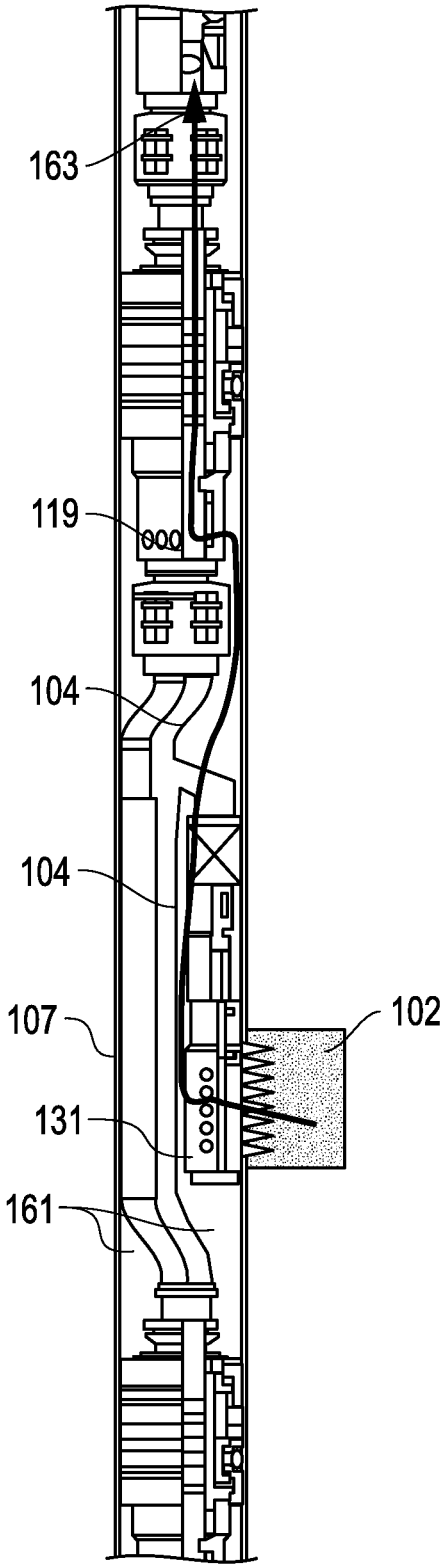

FIGS. 5*a* and 5*b* describe a system 100 substantially similar to the system described in reference to FIGS. 2 and 4*a* to 4*c* but in which the perforating guns 123, 131, 133 are positioned alongside the inner tubing 104 as opposed to being integral to the inner tubing 104. In this embodiment, each individual apparatus 116 further comprises a "Y-block" 504 which splits the inner tubing 104 into two paths: a main path in which the layer's material will flow and a derivative path 505 in which the perforating guns 129, 131, 133 are positioned. The perforating guns 129, 131, 133 are thus positioned in a derivative path 505 branching off from an inner tubing 104 of the system 100 in which the layers' material may flow. A blind sub 506, placed in the derivative path, above the side-mounted perforating gun 129, 131, 133, maintains the sealing integrity of the inner tubing 104.

Figure 6A:
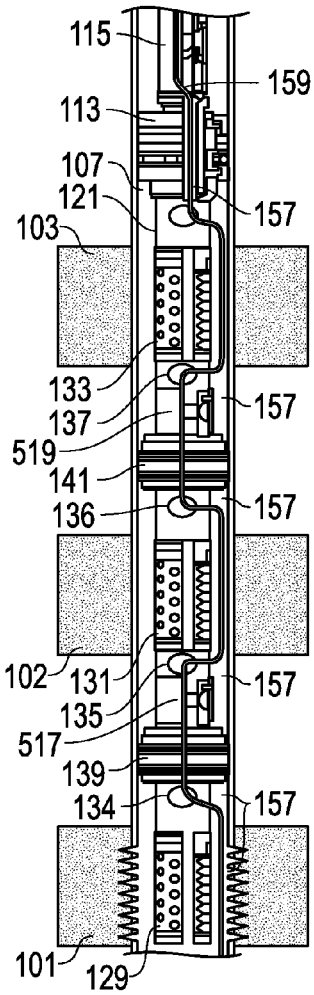
FIGS. 6*a* to 6*c* illustrate the sequential multi-zone testing using the system according to another embodiment of the present invention.
Figure 6B:
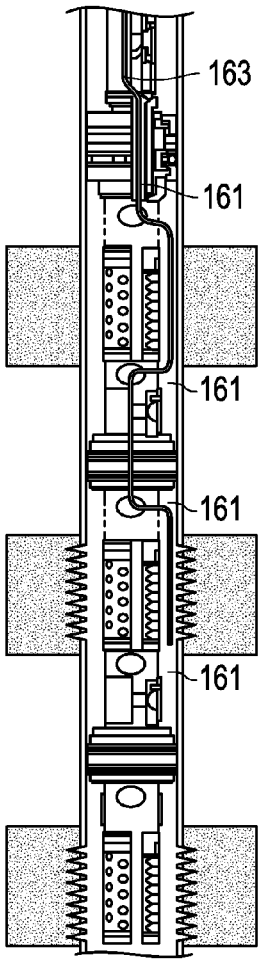
Figure 6C:
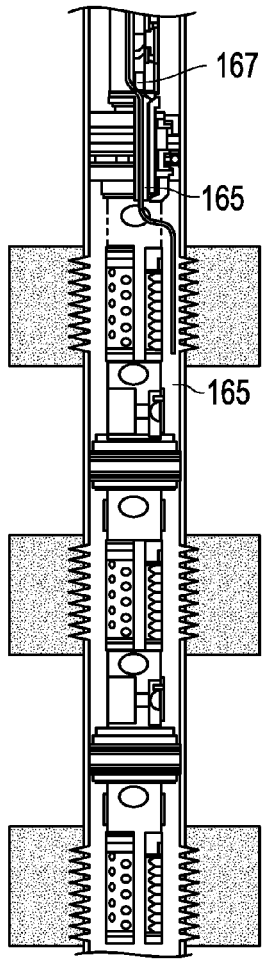

FIGS. 6*a* to 6*c* describe a system 100 substantially similar to the system described in reference to FIGS. 2 and 4*a* to 4*c* but in which the tester sleeve valves 117, 119, 121 are replaced by tester ball valves 517, 519. In this embodiment of the present invention, each individual apparatus 116 comprises a first flow port 135, 137 enabling layer material to flow from the inner tubing 104 of the system 100 into the well case 107 and a second flow port 134, 136, 138 enabling layer material to flow from the well case 107 into the inner tubing 104 of the system 100. Further, one with skill in the art would appreciate that the tester sleeve valves 117, 119, 121 of the system described in FIGS. 5*a* and 5*b* may also be replaced by tester ball valves.

The multizone testing system described enables the various layers to be tested individually and sequentially, starting from the bottom, as well as commingled, as it is described now.

According to a second aspect, the present invention concerns a multizone testing method for the testing of a plurality of subterranean layers 101-103 intersected by a well 107, using a multizone testing system 100 as described above. The method comprises the steps of:

(a) running and positioning said system 100 in the well 107 such that each individual apparatus 116 is adjacent to a layer 101-103 to be tested;

(b) controlling the remotely activated tools of the individual apparatuses 116 for a sequential test of the layers 101-103.

In a preferred embodiment, and in reference to the multizone testing system 100 described above as shown on FIGS. 2 to 6, step (b) comprises the following steps:

(b1) setting the packers 113, 139, 141;

(b2) keeping all the valves open 115, 117, 119, 121;

(b3) perforating the first layer of interest 101 using the perforating gun system 129 of the first individual tool 116 adjacent to said first layer 101;

(b4) testing the flow 159 of the first layer 101;

(b5) closing the tester valve 117 of the first individual tool 116;

(b6) keeping all the valves 115, 119, 121 open except the ones of the layers already tested 117;

and repeating steps (b3) to (b6) for the testing of each layer 102-103.

In preferred embodiments, step (b) may comprise one of all of the following steps:

measuring the pressure of the flow 159 using the pressure gauge 123, 125, 127;

collecting samples of the corresponding tested layer material using the sample carrier;

analyzing the corresponding tested layer material 157 with the fluid analyzer 143 of the upper subsystem 109;

measuring the flow of the corresponding tested layer material 159 with the flow meter 145 of the upper subsystem 109.

According to the method, the testing of the pressure build up for each of the layer 101-013 is also possible. For example, after the closing of the tester valve 117 of the first individual tool 116, said testing is achieved using the pressure gauge 123 of the first individual tool 116 (step b4').

In yet another preferred embodiment, the method also comprises the testing of the commingled flow and commingled pressure build-up. Testing of the commingled flow may be achieved for example by:

(b8) reopening all the tester valves 117, 119, 121;

(b9) measuring the commingled flow using the flow meter 145 and/or measuring the pressure of said commingled flow using the backup pressure gauge and/or the pressure gauges 123, 125, 127 of the individual apparatuses 116.

Testing of the commingled pressure build-up may be achieved for example by:

(b10) closing the main dual-valve 115 of the upper subsystem 109;

(b11) measuring the commingled pressure build-up using the backup pressure gauge and/or the pressure gauges 123, 125, 127 of the individual apparatuses 116.

The same method may be applied using a system 100 in which each individual apparatus 116 further comprises a "Y-block" 504 which splits the inner tubing 104 into two paths: a main path in which the layer's material will flow and a derivative path 505 in which the perforating guns 129, 131, 133 are positioned.

The same method may further be applied using a system 100 where the tester sleeve valves 117, 119, 121 are replaced by tester ball valves 517, 519.

The method is now described in more details according to exemplary embodiments and with references to FIGS. 4, 5, 6 and 7.

As shown on FIGS. 4*a* and 7*a*, the lower layer of interest 101 is first perforated via the first-layer perforating gun system 129. Layer material 157 is flowed (the flow is schematically represented by the arrow 159) through the open first-layer tester valve 117 into the inner tubing 104 of the testing system 100. It goes up through the first-layer isolation packer 139 before exiting, via the second-layer flow port 135, in the well bore's 107 zone adjacent to the second layer 102. The flow 159 then goes back into the inner tubing 104 of the testing system 100 via the open second-layer tester valve 119. Then it goes through the second-layer isolation packer 141 and back into the well bore's 107 zone adjacent to the third layer 103 via the third-layer flow port 137. It finally goes back again into the inner tubing 104 of the testing system 100 via the open third-layer tester valve 121 and so on up to the upper part 109 of the testing system 100 above the main packer 113.

During the flow period (159), the first layer 101 is tested. For example, pressure, L1Fl, is measured by the first-layer pressure gauge 123 and layer material 157 is sampled by the sampler carrier and/or analyzed by the fluid analyzer 143.

At the end of the flow period (159), the first-layer tester valve 117 is actuated close via the wireless communication system to record the bottom hole pressure build-up, L1Bup, using the first-layer pressure gauge 123.

Once this is completed, and while maintaining the first-layer tester valve 117 closed, the next layer of interest 102 up the well 107 is perforated with the second-layer perforating gun system 131 and layer material 161 is flowed (163) into the inner tubing 104 of the testing system 100 through the open second-layer tester valve 119, as shown on FIGS. 4*b* and 7*b*. Then it goes up through the second-layer isolation packer 141 before exiting in the well bore 107 via the third-layer flow port 137. It finally goes back into the inner tubing 104 of the testing system 100 via the open third-layer tester valve 121 and so on up to the upper part 109 of the string 105 above the main packer 113.

During the flow period (163), the layer 102 is tested. For example, pressure, L2FI, is measured by the second-layer pressure gauge 127 and layer material 161 is sampled by the sampler carrier and/or analyzed by the fluid analyzer 143.

Further, as the first-layer tester valve 117 is maintained closed, the build-up pressure of the first layer 101 may be measured using the first-layer pressure gauge 123, which enables to test the effect of the flow 163 of the second layer 102 on the pressure build-up of the first layer and to detect if there is communication or leak between the two layers 101 and 102 (interference test).

At the end of the flow period (163), the second-layer tester valve 119 is actuated close via the wireless communication system to record the bottom hole pressure build-up, L2Bup, using the second-layer pressure gauge 127.

Finally, as shown on FIGS. 4*c* and 7*c*, while maintaining the first-layer and second-layer tester valves 117, 119 closed, the third layer of interest 103 is perforated with the third-layer perforating gun system 133 and layer material 165 is flowed (167) into the inner tubing 104 of the testing system 100 via the open third-layer tester valve 121. It then goes up to the upper part 109 of the testing system 100 above the main packer 113.

During the flow period (167), the layer 103 is tested the same way as the previous layers. For example, pressure, L3Fl, is measured by the third-layer pressure gauge 127 and layer material is sampled by the sampler carrier and/or analyzed by the fluid analyzer 143.

Once again, interference tests may be performed, to measure the effect of the flow of the third layer on the build-up of the first and second layers, using the pressure gauges 123, 125 and while maintaining the first-layer and second-layer tester valves 117, 119 closed, in order to detect if there is communication or leak between the layers 101-103.

At the end of the third flow period 167, the third-layer tester valve 121 is actuated close via the wireless communication system to record the bottom hole pressure build-up, L3Bup, using the third-layer pressure gauge 127.

The same method is repeated for any additional layer that needs to be tested in the well 107.

Once all layers have been tested individually (flow and pressure build-up), all lower tester valves 117, 121, 123 may be reopened to allow all layers to flow commingled. A final global pressure build-up may be recorded by closing the main dual valve 115, as shown on FIG. 7*d*. For example, the commingled flow pressure, CFI, is measured by any of the pressure gauges 123, 125, 127 and/or by the back-up pressure gauge. The final global pressure build-up, CBup, may be recorded by any of the pressure gauges 123, 125, 127.

We describe now an example of the method according to the invention with reference to FIGS. 5*a* and 5*b*. The method is adapted to a system 100 as described previously but further comprising a "Y-block" 504 which splits the inner tubing 104 into two paths: a main path in which the layer's material will flow and a derivative path 505 in which the perforating guns 129, 131, 133 are positioned. FIGS. 5*a* and 5*b* represent the method being applied only to one layer of interest 102. The same description may be applied to any other layer of interest.

One layer below the layer of interest 102 has already been perforated and layer material 157 is flowing (159) in the inner tubing 104, as shown on FIG. 5*a*. The layer 102 is perforated via the layer perforating gun system 131. Then, layer material 161 is flowed (163) in the well case 107 around the perforating gun 131 and up into the inner tubing 104 through the open sleeve valve 119, and then up to the next individual apparatus 116 or to the surface, as shown on FIG. 5*b*.

We describe now an example of the method according to the invention with reference to FIGS. 6*a* to 6*c*. The method is adapted to the use of tester ball valves 517, 519.

The first layer 101 is perforated the same way as previously explained. Then, layer material 157 is flowed (159) through the first-layer flow port 134 into the inner tubing 104 of the testing system 100. It goes up through the first-layer isolation packer 139 and through the open first-layer tester valve 117. It then exits, via the lower second-layer flow port 135, in the well bore's 107 zone adjacent to the second layer 102. The flow 159 then goes back into the inner tubing 104 of the testing system 100 via the upper second-layer flow port 136, goes through the second-layer isolation packer 141 and through the open second-layer tester valve 119. It then goes back into the well bore's 107 zone adjacent to the third layer 103 via the lower third-layer flow port 137. It finally goes back again into the inner tubing 104 of the testing system 100 via the upper third-layer flow port 138 and so on up to the upper part 109 of the testing system 100 above the main packer 113.

The flows 163, 167 of the layer material 161, 165 of all the other layers 102, 103 to be tested follow the same path as the flow 159 of the first layer 101 starting from the well bore's 107 zone adjacent to the tested layer.

The system according to the invention further enables to convey the data from the testing means of the individual apparatuses to the station in real time using the wireless communication means.

While the invention is described in relation to preferred embodiments and examples, numerous changes and modifications may be made by those skilled in the art regarding parts of the downhole multi-zone testing system and steps of the testing method without departing from the scope of the invention. The advantages of the downhole multi-zone testing system and method as described above include, among others:

Time saving as several zones may be tested individually and together within a single trip in the well of test system.

The data may be accessed in real-time from surface via the wireless communication system.

The status of any given apparatus is accessible in real-time from surface via the wireless communication system.

The various apparatuses may be activated at will from surface via the wireless communication system.

The build-up on the lower zones may be extended whilst testing the layers located above.

Sequential interference tests may be performed between an active (flowing) layer and any shut-in layer located below.

Under ideal conditions of zonal isolation, further time gains may be obtained by starting to flow one layer as soon as the previous one has been shut-in.

In an alternative embodiment, communication between the control station and the surface may also be accomplished by an electrical cable. Many variations of the present invention may be readily envisioned by a person skilled in this art without departing from the scope of the present invention as it is defined in the appended claims.

The invention claimed is:

1. A multizone testing method for testing a plurality of subterranean layers intersected by a well, comprising:

(a) running a multizone testing drill stem testing system into the well, the multizone testing system comprising an upper subsystem, a lower subsystem, and a communication system, wherein:

the upper subsystem comprises:

a wireless control station, and a main isolation packer for isolating the upper subsystem from the lower subsystem;

the lower subsystem comprises:

an array of individual apparatuses connected in series, each individual apparatus being adapted for the testing of one layer and comprising a series of remotely activated tools for hydraulically isolating and testing a corresponding layer; and the communication system comprises:

communication means between the control station and the surface and between the control station and each of the individual apparatuses in order to control the remotely activated tools of each of the individual apparatuses for sequential testing of the layers;

(a') positioning the multizone testing system into the well such that each of the individual apparatuses of the lower subsystem is adjacent to a layer to be tested;

(b) sequentially testing the subterranean layers, for performing a well test, by controlling the remotely activated tools of the individual apparatuses; and (c) controlling the remotely activated tools of the individual apparatuses for a commingled test of at least two tested adjacent layers via reopening the tester valves of at least two already tested adjacent layers and testing the commingled flow.

2. The method of claim 1, wherein the remotely activated tools comprise wirelessly remotely activated tools and (b) further comprises sequentially testing the subterranean layers, for performing a well test, by wirelessly controlling the wirelessly remotely activated tools.

3. The method of claim 1, wherein the wirelessly remotely activated tools comprise a wirelessly remotely controllable pressure gauge.

4. The method of claim 1, wherein the wirelessly remotely activated tools comprise a wirelessly remotely activated packer for isolating one layer from another adjacent layer.

5. The method of claim 1, wherein the wirelessly remotely activated tools comprise a wirelessly remotely activated perforating gun system.

6. The method according to claim 1, further comprising:

(d) controlling the remotely activated tools of the individual apparatuses for performing an interference test between the currently tested layer and one or a plurality of previously tested layers.

7. The method according to claim 1, wherein (b) further comprises: sequentially testing the subterranean layers, for performing a well test, by wirelessly controlling the remotely activated tools of the individual apparatuses.

8. The method according to claim 1, wherein (c) further comprises wirelessly controlling the remotely activated tools of the individual apparatuses for a commingled test of at least two tested adjacent layers via reopening the tester valves of at least two already tested adjacent layers and testing the commingled flow.

9. The method according to claim 2, wherein (c) further comprises:

controlling the remotely activated tools of the individual apparatuses for a commingled test of all the tested layers via reopening all the tester valves and testing the commingled flow.

10. The method according to claim 9, wherein the upper subsystem comprises a main dual-valve, and (c) further comprises closing the main dual-valve and testing the commingled build-up.

11. The method according to claim 1, further comprising:

(d) conveying to the surface the data collected by each testing means of the individual apparatuses.

12. The method according to claim 11, wherein conveying the data is made in real-time.

13. The method according to claim 1, wherein the remotely activated tools of each of the individual apparatuses further comprises a packer, a tester valve, and testing means, and wherein (b) further comprises:

(b1) setting each of the packers;

(b2) maintaining each of the tester valves in an open position;

(b3) perforating the first layer of interest using the perforating gun system of a first individual apparatus adjacent to a first layer;

(b4) testing a flow of the first layer;

(b5) closing the tester valve of the first individual apparatus;

(b6) keeping each of the tester valves open except the ones of the layers already tested and repeating (b3) to (b6) for the testing of each layer.

14. The method according to claim 13, wherein the testing means comprises a pressure gauge, and (b) further comprises, after closing the tester valve of the first individual apparatus, (b5') testing a build-up of the first layers' material using said pressure gauge.

15. The method according to claim 13, wherein the testing means comprises a pressure gauge, and (b4) further comprises measuring the pressure of the flow of the first layer using said pressure gauge.

16. The method according to claim 13, wherein the upper subsystem comprises a fluid analyzer, and (b4) further comprises analyzing the corresponding tested layer material with said fluid analyzer.

17. The method according to claim 13, wherein the upper subsystem comprises a flow meter, and (b4) further comprises measuring the flow of the corresponding tested layer material with said flow meter.

* * * * *